United States Patent [19]

Robillard et al.

[11] Patent Number: 5,038,432

[45] Date of Patent: Aug. 13, 1991

[54] COMPARTMENTED ORTHOPEDIC CERVICAL PILLOW

[76] Inventors: George Robillard, 426 Halford Rd., Beaconsfield, Québec, Canada, H9W 3L4; Ivan Drody, 9365 Millen, Montreal, Québec, Canada, H2M 1X1

[21] Appl. No.: 481,630

[22] Filed: Feb. 16, 1990

[51] Int. Cl.[5] ..... A47G 9/00

[52] U.S. Cl. ..... 5/442; 5/434

[58] Field of Search ..... 5/434, 436, 442, 441, 5/440, 437

[56] References Cited

U.S. PATENT DOCUMENTS

| | | | |
|---|---|---|---|
| 1,206,775 | 11/1916 | Everts | 5/442 |
| 2,589,303 | 3/1952 | Sourbeck | 5/442 |
| 4,660,239 | 4/1987 | Thomas | 5/442 |

FOREIGN PATENT DOCUMENTS

| | | | |
|---|---|---|---|
| 59881 | 9/1982 | European Pat. Off. | 5/442 |
| 420722 | 12/1934 | United Kingdom | 5/442 |
| 641838 | 8/1950 | United Kingdom | 5/434 |

*Primary Examiner*—Alexander Grosz

*Attorney, Agent, or Firm*—Swabey, Ogilvy, Renault

[57] ABSTRACT

There is disclosed an orthopedic cervical pillow which is intended to be used to support the neck and head of a person. The pillow is generally rectangular and is made of an upper casing and a lower casing each being sewn together along their edges to constitute the outer cover of the pillow. The pillow is filled with fibre. In addition, it includes two or more elongated pieces of woven material which are disposed lengthwise and upstanding relative to the pillow. Each of these pieces are sewn along their upper and lower edges by continuous lateral stitching respectively to the upper and lower casings. The pieces of woven material are distributed inside the pillow to constitute one central, one wider and one narrower lateral tubular shaped compartments which extend lengthwise inside the pillow. The narrower lateral compartment is wider than the central compartment. This pillow enables the central compartment to receive the occiputal protrusion and one of the lateral compartment to support the cervical area of a person. The wider or narrower lateral compartment will be used depending on the length and shape of the user's cervical area.

4 Claims, 2 Drawing Sheets

COMPARTMENTED ORTHOPEDIC CERVICAL PILLOW

BACKGROUND OF INVENTION (a) Field of the Invention

This invention relates to an orthopedic cervical pillow wherein certain pieces of material cut to specific shapes, configurations, and designs sewn on the inside of the casing of the pillow, can in fact create a specific pillow shape and design so as to provide for an innovatively shaped pillow identifiably different from prior art.

More specifically, the invention is concerned with a pillow that allows for sufficient head and neck support while resting on one's back as well as on one's side, either to the left or to the right by providing for sufficient pillow thickness at each end to accommodate for the distance between the side of the head and face, and the shoulder.

(b) Description of Prior Art

The prior art is constituted by the following references:

U.S. Pat. No. 1,206,775
U.S. Pat. No. 2,589,303
U.S. Pat. No. 4,660,239
British Pat. No. 420,722
British Pat. No. 641,838
European Patent Application No. 59 881—Sept. 15, 1982.

However, none of these references teach a pillow which is capable of constituting a support both for the cervical area as well as the occiputal protrusion of a person.

SUMMARY OF INVENTION

In accordance with the invention, there is provided an orthopedic cervical pillow to support the neck and head of a person, said pillow being substantially rectangular and comprising an upper casing and a lower casing, said upper and lower casings being sewn together along peripheral edges thereof to constitute an outer covering member, and means for filling said covering member to constitute a pillow, wherein said pillow includes at least two elongated pieces of woven material disposed lengthwise and upstanding relative to said pillow, each said pieces of woven material having upper and lower edges sewn by continuous lateral stitching respectively to said upper and lower casings, said pieces of woven material being distributed inside said pillow to constitute at least one central, one wider and one narrower lateral tubular shaped compartments extending lengthwise inside said pillow, said narrower lateral compartment being wider than said central compartment, so constructed and arranged that the central compartment is adapted to receive an occiputal protrusion and one of the lateral compartment supports a cervical area, and that the wider or narrower lateral compartment is used depending on user's cervical length and shape.

DESCRIPTION OF THE PREFERRED EMBODIMENT

Figure 7:
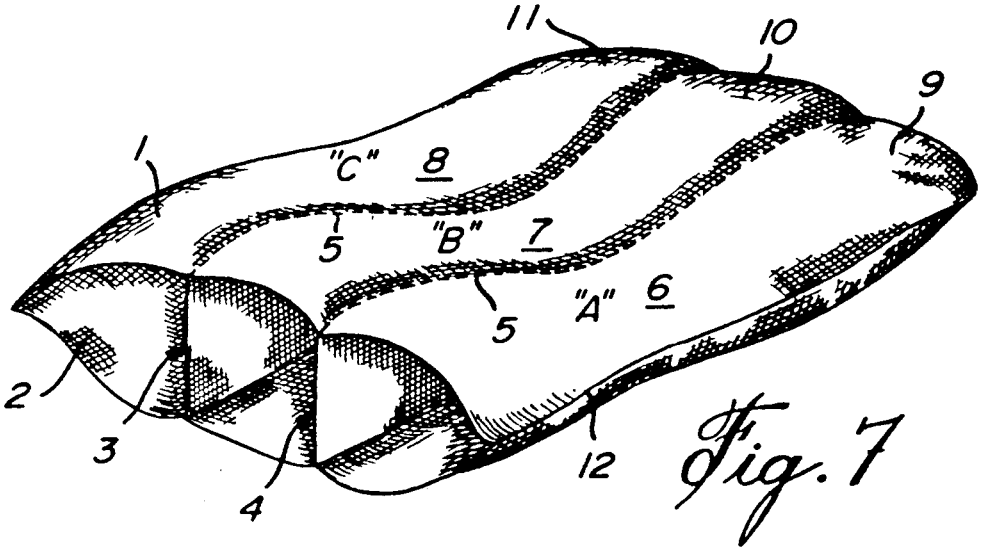
FIG. 7 is a perspective view of a pillow according to the invention, a portion being cutaway to show the mounting of the dividers.

The pillow illustrated in FIG. 7, comprises an upper casing 1 and lower casing 2 sewn by continuous peripherally stitching 12 with the two dividers of identical style and shape 3 and 4 respectively, sewn by continuous stitching 5 to the inside of the upper casing 1 and lower casing 2.

Figure 2:
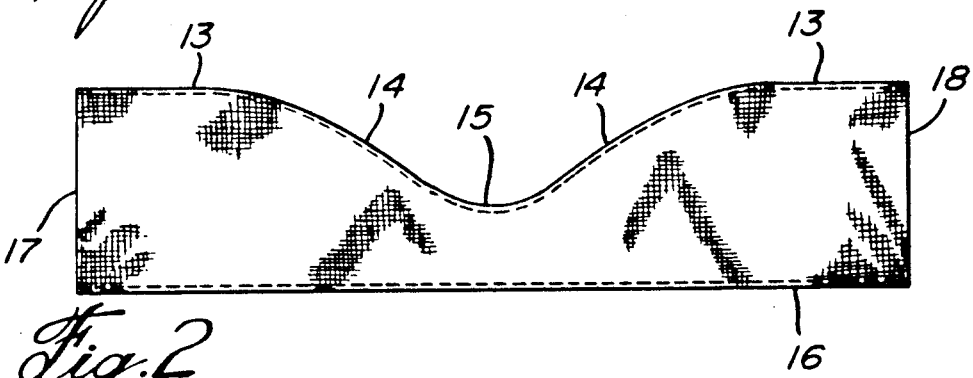
FIG. 2 is a view in elevation of the divider which is used in the manufacturing of a first type of pillow.
Figure 3:
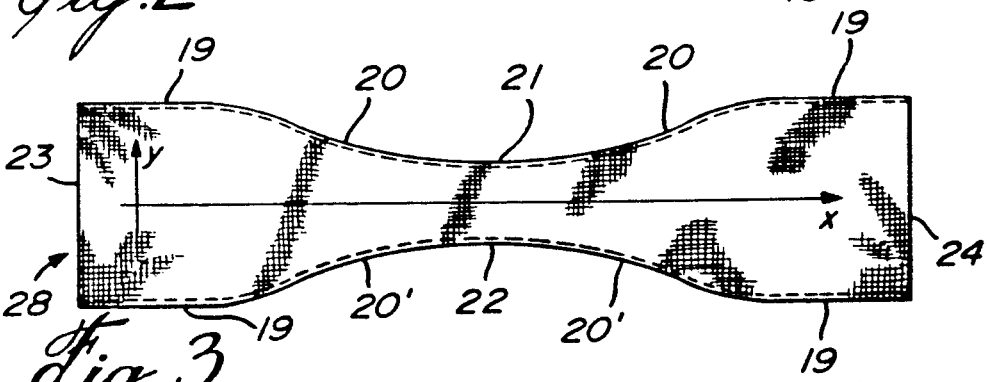
FIG. 3 is a view in elevation of the divider which is utilized in the manufacturing of a second type of pillow.
Figure 4:
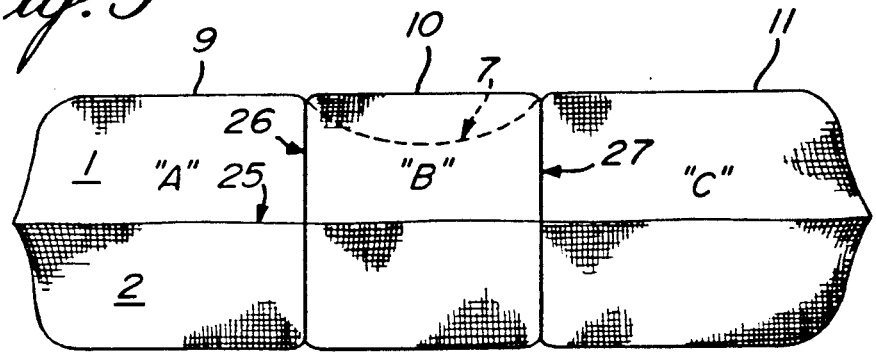
FIG. 4 is a view in elevation of the divider which is utilized in the manufacturing of a third type of pillow.

Depending on whether the creation of a central concave recession on one pillow surface as in FIG. 2 or on both pillow surfaces as in FIG. 3 is desired, the two dividers of identical style and shape are placed vertically within the casings and sewn in place by continuous stitching as shown in FIG. 7. The pillow has three separate longitudinal compartments of different widths to accommodate different neck lengths.

Compartment "A" as shown in FIGS. 1, 4, 5, 6, 7 is narrower in width than compartment "C" and, the middle compartment "B" is narrower than both "A" and "C".

There are two possible shapes of dividers which can be used depending on whether a central concave recession on one or both pillow surfaces is desired.

Two dividers of identical style and shape are required per pillow. As in FIG. 7, the divider of FIG. 2 is of rectangular shape and the upper line starts from each end 13 and travels horizontally and then gradually and progressively recedes towards the center 14 thereby creating a centrally concave recession with the vertex being at the centre of the divider 15. The second style is shown in FIG. 3. Divider 28 is of rectangular shape with an upper horizontal line 19 which starts from each end of said divider and travels horizontally and gradually downward at 20 to the absolute minimum 21, and a lower horizontal line 19 which starts from each end of said divider and travels horizontal and gradually upward at 20' to an absolute maximum 22, and the end vertical lines 23 and 24. The materials are of woven textile and the filling material could be either fibre, duck-down, or any other filling material of choice.

Figure 5:
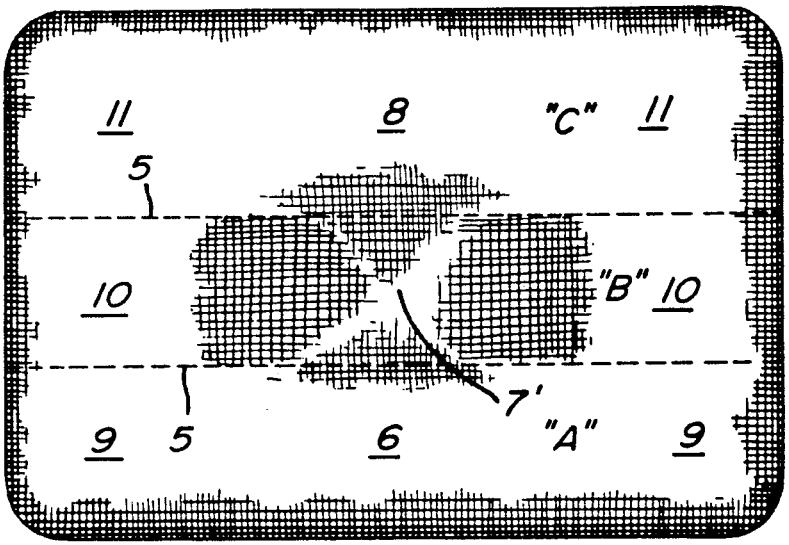
FIG. 5 is a drawing of a perspective view of a finished pillow with a showing of the central recession approximation.

The top face of the surface of the pillow as in FIG. 5, illustrates the disproportional compartmental widths "A", "B", and "C" and the approximation of the central recession 7'.

Figure 6:
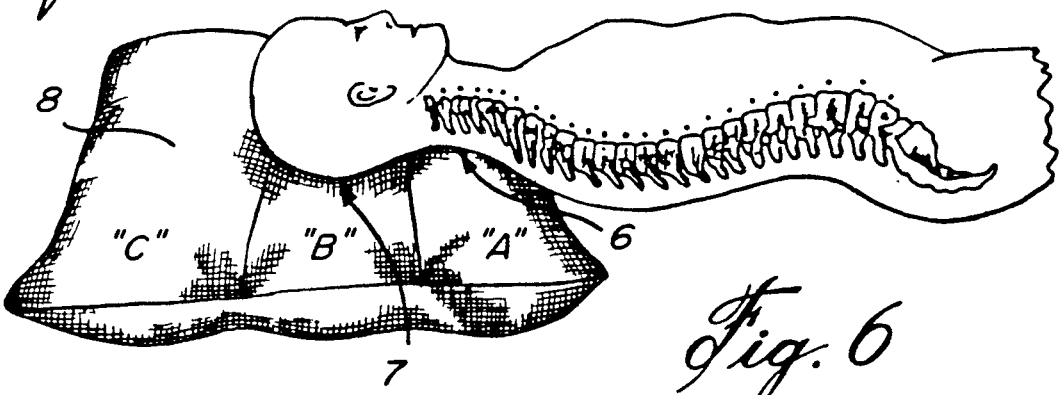
FIG. 6 is a perspective view showing the approximate position of the head resting on the pillow and the simultaneous support for the cervical area.

The method in which the pillow should be used is illustrated as in FIG. 6 which shows the approximation of the positioning of the neck 6 and head 7. The longitudinal compartment 8 is wider for longer neck length.

Figure 1:
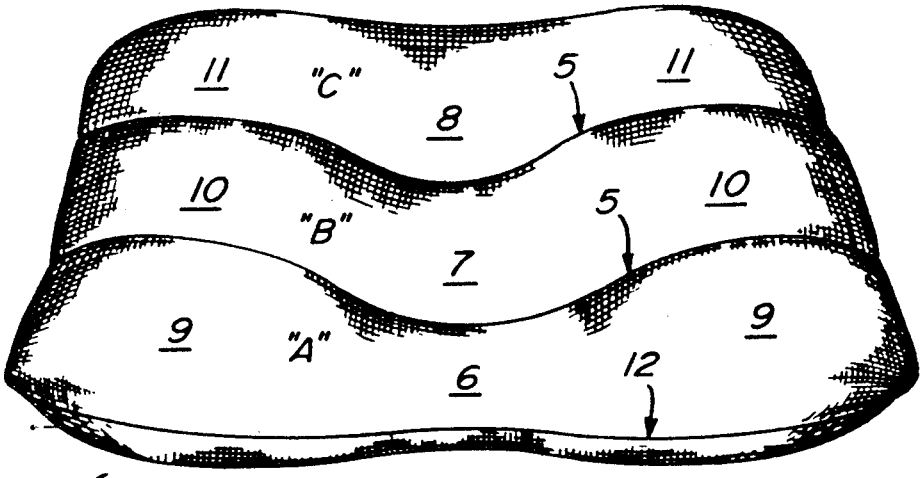
FIG. 1 is a view of the top surface of the pillow showing the sectional differences in width dimensions with their location and central recession.

The completed orthopedic cervical pillow as shown in FIG. 1 includes a surface with uniform surface ends 9, 10 and 11 respectively for the side of the head support, two cervical support areas 6 and 8 respectively, and a central recession 7.

We claim:

1. An orthopedic cervical pillow to support the neck and head of a person, said pillow being substantially rectangular and comprising an upper casing and a lower casing, said upper and lower casings being sewn together along peripheral edges thereof to constitute an outer covering member and fiber means for filling said covering member to constitute a pillow, wherein said pillow includes at least two elongated pieces of woven material disposed lengthwise and upstanding relative to said pillow, each said pieces of woven material having upper and lower edges sewn by continuous lateral stitching respectively to said upper and lower casings, the upper edges of said elongated pieces of woven material having first terminal straight portions joining a downward central substantially concave portion, said pieces of woven material being distributed inside said pillow to define at least one central, one wider and one narrower lateral tubular shaped compartments extending lengthwise inside said pillow;

said narrower lateral compartment being wider than said central compartment; and so constructed and arranged that in use the central compartment is adapted to receive the occiputal protrusion and one on the lateral compartments supports the cervical area, and that the wider or narrower lateral compartment is used depending on user's cervical length and shape.

2. A pillow according to claim 1, which comprises one central, one wider lateral and one narrower lateral tubular shaped compartment.

3. A pillow according to claim 1, wherein the lower edges of said elongated pieces of woven material have second terminal straight portion joining an upward central substantially concave portion.

4. A pillow according to claim 1, wherein said upper and lower edges of said piece of woven material extend horizontally along a straight line.

* * * * *